United States Patent [19]

Eglinton et al.

[11] 4,173,108

[45] Nov. 6, 1979

[54] SPIRAL WRAPPING APPARATUS

[75] Inventors: Robert B. Eglinton, Huntington Beach; James L. Tuell, Manhattan Beach, both of Calif.

[73] Assignee: Chromalloy American Corporation, New York, N.Y.

[21] Appl. No.: 890,540

[22] Filed: Mar. 27, 1978

[51] Int. Cl.[2] ..... B65B 11/04

[52] U.S. Cl. ..... 53/587; 53/211

[58] Field of Search ..... 53/211, 587; 93/80; 100/13; 83/614

[56] References Cited

U.S. PATENT DOCUMENTS

| | | | |
|---|---|---|---|
| 1,309,424 | 7/1919 | Seiberung | 93/80 |
| 1,562,645 | 11/1925 | Jones | 100/13 |
| 1,870,399 | 8/1932 | Butler et al. | 53/211 X |
| 2,344,372 | 3/1944 | Sikstrom | 83/614 |
| 2,716,315 | 8/1955 | Jacoby | 53/587 |
| 3,055,278 | 9/1962 | Kinneman, Jr. | 93/80 X |
| 3,641,854 | 2/1972 | Keesling | 83/614 |
| 3,928,939 | 12/1975 | Edwards et al. | 93/80 X |

*Primary Examiner*—John Sipos
*Attorney, Agent, or Firm*—William W. Haefliger

[57] ABSTRACT

Apparatus to progressively spiral wrap a sheet about a longitudinally axially elongated generally cylindrical object comprises:

(a) a frame including a beam member extending in the general direction of said object axis, and at a higher elevation than said axis, (b) a head carried by the beam for displacement therealong, (c) support structure carried by the head to support a sheet roll to rotate about another axis angled from horizontal and to directionally feed the sheet toward and into parallel and close tangency to the object, in a skew feed direction relative to the object axis, whereby as the object is rotated about its axis and said head is displaced along the frame member the sheet unwinds from the sheet roll and becomes progressively spirally wrapped about the object.

10 Claims, 9 Drawing Figures

50
51
52
44a
53
54
26b
18
26d
47
16
48
15
13
43
44
55
69
56
16b
26c
26a
3
3
12
11
13
14

44a
47b
47a
47
48
43
2
2
110
111
13
44'
α
40
11
44
18
26d
16b
17
12
50
51
55
56
52
51
51a
16a
26
16
46
42
10

SPIRAL WRAPPING APPARATUS

BACKGROUND OF THE INVENTION

This invention relates generally to wrapping apparatus, and more particularly concerns equipment operable to quickly and easily effect spiral wrapping of sheet material, such as heavy paper, about roll shaped objects. Examples of the latter are heavy carpet rolls.

Roll shaped objects such as carpets are bulky and difficult to handle; nevertheless, they must be protectively wrapped for shipment. In the past, various techniques and expedients were employed for this purpose, but they proved to be less than fully satisfactory, were time consuming to operate, and require expensive manual labor to control and operate. No prior equipment of which we are aware provides the unusual combinations and interrelated subcombinations of structure, functions and results as are now afforded by the present invention, and which achieve rapid, efficient, and low cost spiral wrapping of bulky objects, such wrappings being of high quality.

SUMMARY OF THE INVENTION

It is a major object of the invention to provide apparatus overcoming problems with prior wrapping techniques and apparatus. Basically, the present apparatus for wrapping a sheet about an elongated generally cylindrical object comprises:

(a) first means to support the sheet for feeding toward and into parallel and close tangency to the object in a skew feed direction relative to the object axis, and (b) second means carrying said first means for relative travel in the progressive spiral wrap direction whereby as the object is rotated about said axis, and as said first means travels in said travel direction the sheet becomes progressively helically wrapped about the object.

As will be seen, the first means may include a support structure or head to support a sheet roll for unwinding rotation to dispense the sheet toward the object to be wrapped and in response to the latter's rotation; the second means may include an elongated beam member extending in the general direction of the object's axis but at a higher elevation than that axis, the beam member carrying the support structure or head for travel along the beam in response to feed of the sheet; the beam member extends typically at a downhill angle such that tension developed in the sheet during its feed produces a force sufficient to displace the head along the beam; the head is positioned to incline the sheet roll at an inclined angle relative to the axis of the roll to be wrapped so that advantage is taken of the helical wrap angle thereby produced to produce a force tending to advance or travel the head along the beam as described; the beam member may be adjustably tiltable to facilitate return of a truck carrying the head toward start position after completion of a wrap cycle; the head may be selectively inclined to achieve different helical wrap angles about the roll to be wrapped; a brake is provided to control unwinding rotation of the wrap sheet roll, to aid in development of forces tending to advance the head along the beam; the braking action is desirably varied to compensate for changes in angular momentum of the sheet roll as the roll reduces in diameter; and means to controllably and selectively sever the sheet is provided, as will be seen.

These and other objects and advantages of the invention, as well as the details of an illustrative embodiment, will be more fully understood from the following description and drawings, in which:

DRAWING DESCRIPTION

DETAILED DESCRIPTION

Figure 2:
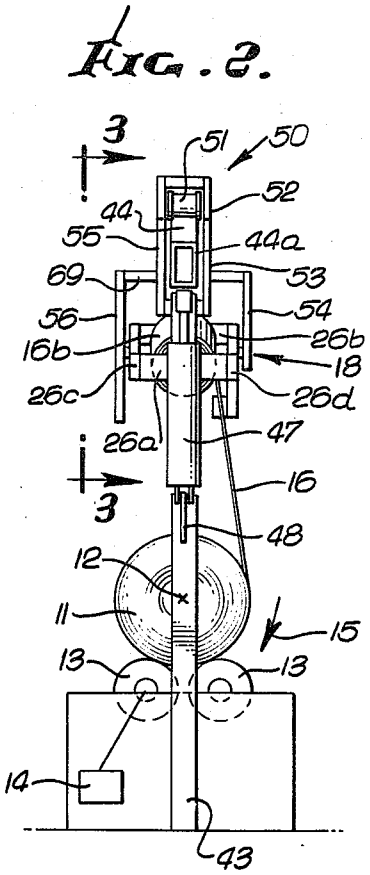
FIG. 2 is an end elevational view of the FIG. 1 apparatus taken on lines 2—2 of FIG. 1.
Figure 1:
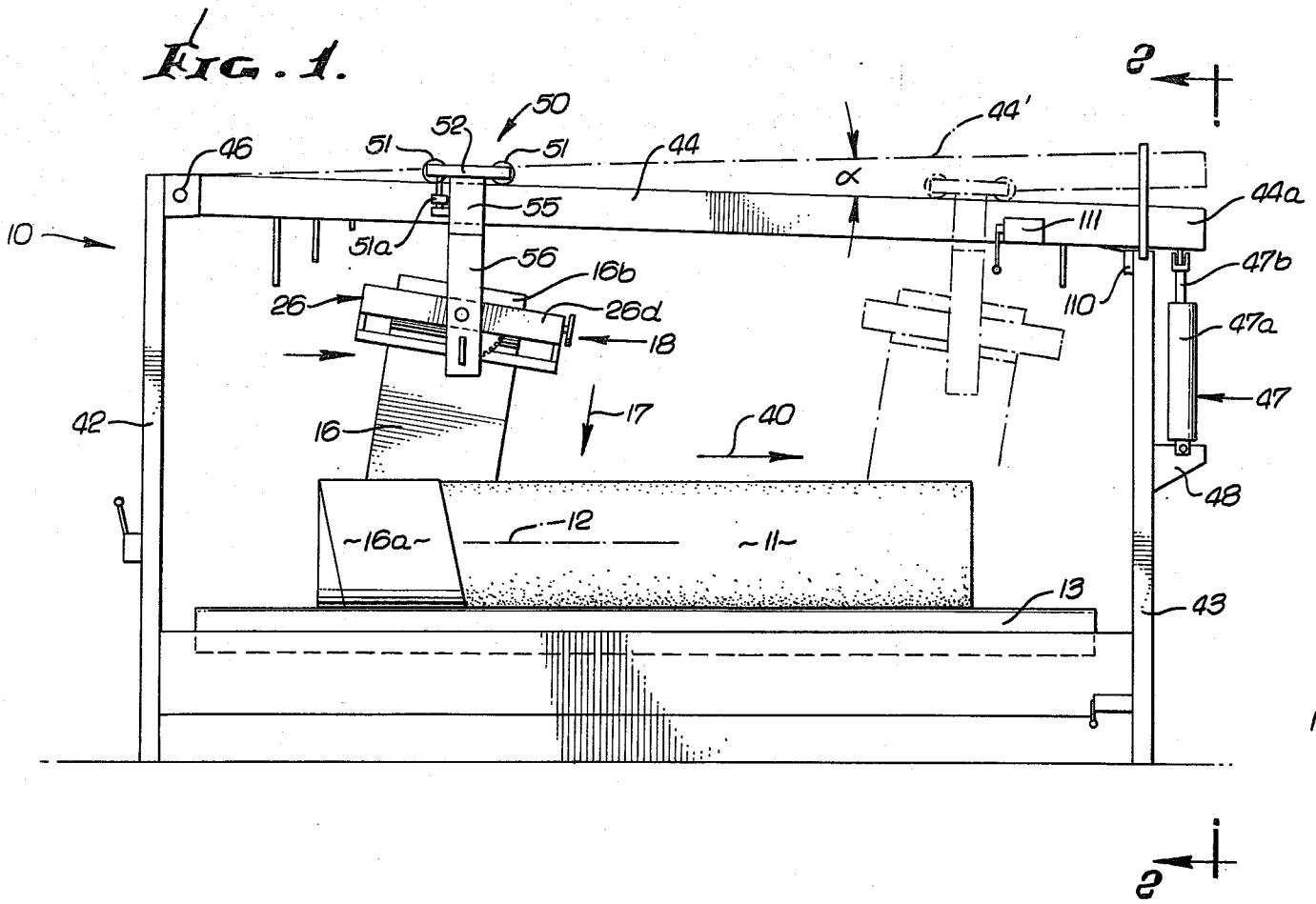
FIG. 1 is a general frontal elevational view of apparatus incorporating the invention.

Referring first to FIGS. 1 and 2, apparatus 10 is shown to progressively spiral wrap a sheet about a longitudinally axially elongated generally cylindrical object. The latter may typically take the form of a carpet roll 11, with longitudinal axis 12, and supported on rollers 13. Suitable means to rotate one or both rollers is indicated schematically at 14, in FIG. 2, the direction of carpet roll rotation indicated by arrow 15. The sheet 16 to be wrapped helically about the carpet, as shown by wrap 16*a*, may consist of Kraft paper, or other suitable material, of paper or other composition.

In accordance with the invention, first means is provided to support the sheet for feeding toward, and into close parallel tangency to, the object such as roll 11, in a skew feed direction (as indicated by arrow 17) relative to axis 12. Such first means may with unusual advantage include support structure to support a sheet roll 16*b* for unwinding rotation to dispense or feed the sheet 16 toward the roll 11 to be wrapped. The support structure may take the form as shown at 18, and include frustoconical end supports 19 and 20 respectively penetrating opposite ends 21 and 22 of the paper roll 16*b*.

Figure 3:
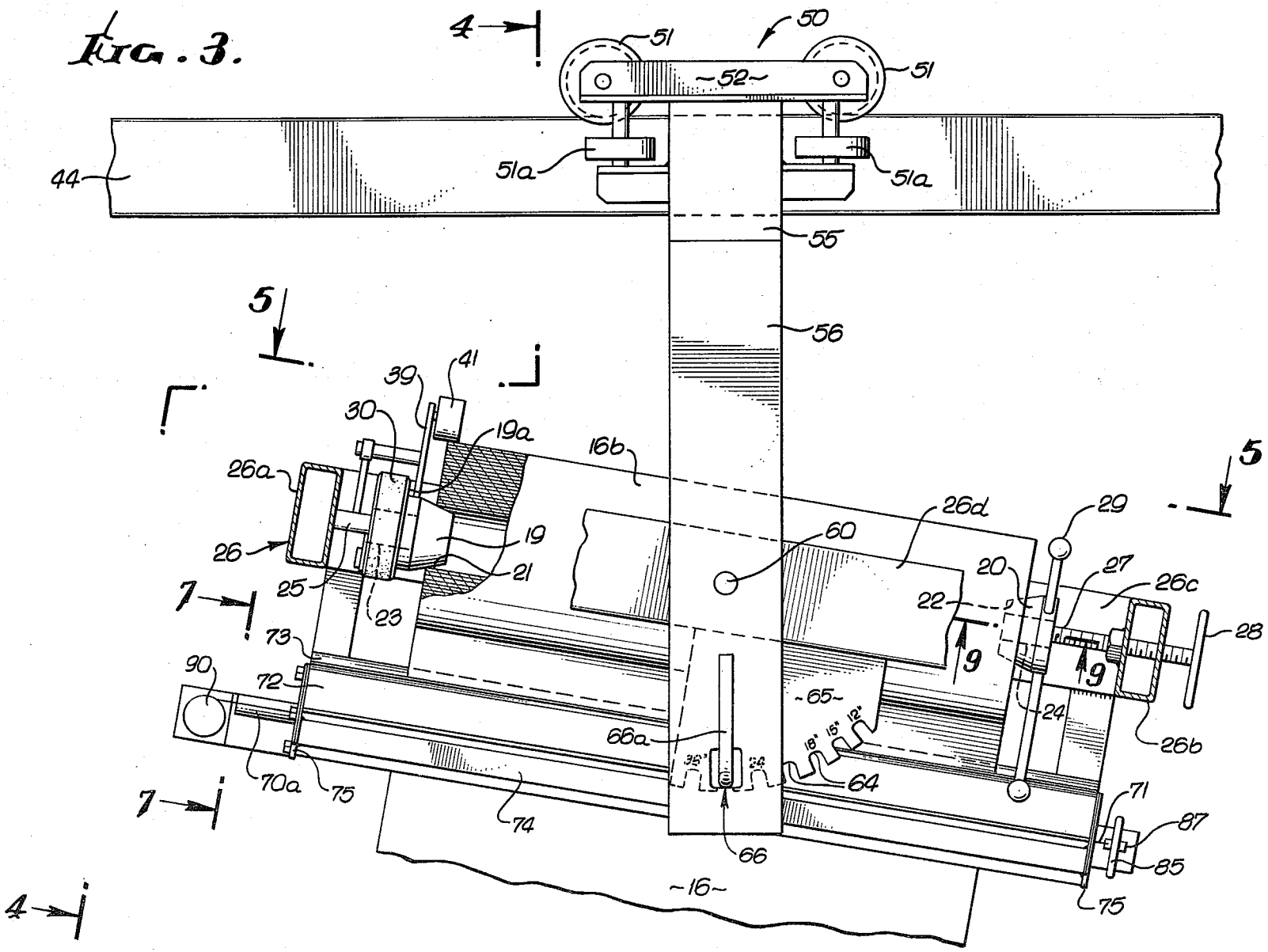
FIG. 3 is an enlarged fragmentary end view taken on lines 3—3 of FIG. 2.
Figure 9:
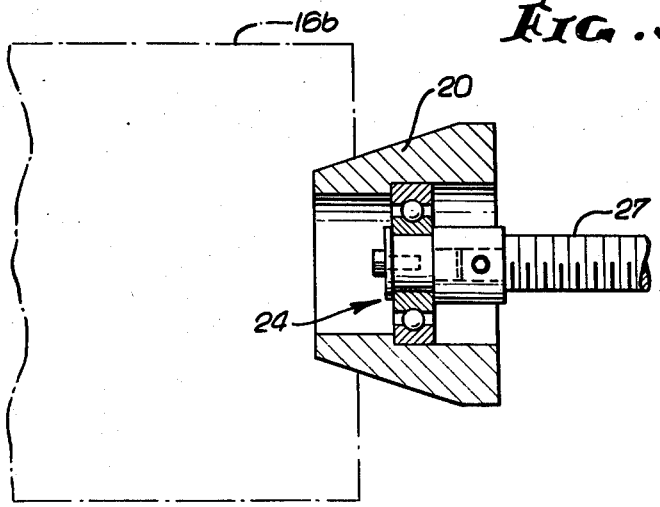
FIG. 9 is an enlarged upward looking section taken on lines 9—9 of FIG. 3.

The end supports are freely rotatable about spindles indicated at 23 and 24 in broken lines in FIG. 3. Spindle 23 is carried by a shaft 25 attached to leg 26*a* of a rectangular frame 26 which also includes legs 26*b*—26*d* as shown. Spindle 24 is carried by a threaded shaft 27 which projects through and has threaded connection with frame leg 26*b*. See also FIG. 9. A hand wheel 28 at the end of shaft 27 is operable to rotate the shaft 27 to retract or advance same, along with spindle 24 and rotary end support 20 relative to member 26*b*. Accordingly, retraction of end support 20 allows replacement of paper roll 16*b*. Handle bar 29 on end support 20 allows turning of that support to rotate the paper roll (endwise clamped to same) to advance or retract the paper feed at 16, by hand, as during start-up adjustment, or application of paper covering at the end of the carpet roll after the endwise extent of the carpet roll has been completely covered, helically.

A brake mechanism is provided to be operatively connected with the sheet roll support structure and sensing the diameter of the sheet roll to decreasingly resist unwinding rotation of that roll as it reduces in diameter, i.e. as the sheet (such as heavy paper) spools off that roll. Referring to FIGS. 3–6, the brake includes a flexible brake band 30 partly wrapped about an annular drum portion 19*a* of end support 19, one end of the band anchored at 31 to the frame member. The opposite end 30*a* of the band is attached via tension spring 32 to a bell crank lever 33 pivoted at 34 to the frame member 26*c*. Spring 32 attaches at 35 to the lever 33. The latter is also connected at 36 to a link 37 which is pivotally connected at 38 to sensing lever 39. Lever 39, pivotally connected at 40 to frame member 26*c*, includes a sensor roller 41 in rolling contact with the sheet roll 16*b*. As the latter decreases in diameter due to spooling off of the sheet outer winding, the arm 39 pivots downward in FIG. 6, spring 33 serving the dual functions of urging the arm 39 clockwise and also yieldably urging the brake band against the drum surface 19*a*. Tension in the spring diminishes as the lever 39 pivots downwardly, decreasing the braking effect. It is found that this compensates for "lightening" of the paper or sheet roll 16*b*, i.e. reduction in its angular momentum, so that paper may be successfully pulled off the rotating sheet roll in response to rotation of the carpet roll, and endwise travel of the head or frame 26, to be described, to serve the purpose of optimum wrapping of the carpet roll. In this regard, the angular momentum of the sheet roll aids spooling off of paper, but this "aiding" effect diminishes as angular momentum diminishes, so that compensation for this effect is provided.

Referring back to FIGS. 1 and 2, second means is provided to carry the first means (referred to above) for relative travel in the progressive spiral wrap direction (indicated by arrow 40) as the object such as carpet roll 11 is rotated about its axis 12, whereby as the first means travels in said relative travel direction the sheet 16 becomes progressively helically wrapped at 16*a* about the object. Such second means may typically includes frame uprights 42 and 43, and an elongated beam member 44 extending in the general direction of axis 12, at a higher elevation than that axis. The beam member 44 carries the support means 18 for movement along its length in response to feed of the sheet or strip 16 off the roll 16*b* and downwardly toward the roll 11 to be wrapped. Note that the beam member 44 extends at a downhill angle $\alpha$ such that tension developed in the sheet 16 during feed thereof produces a force sufficient to displace the head or support structure 18 along the beam member and at a speed corresponding to the axial rate of spiral wrap advancement along the object or roll 11. This functioning is also aided by the braking of the sheet roll 16*b* previously described.

FIG. 1 shows beam member 44 pivotally connected at 46 to the upright 42; also, the opposite end of the beam is supported to be raised or lowered, i.e. to adjust the angle $\alpha$ of tilt of the beam member between a first or lower position, as shown, in which the support structure 18 travels rightwardly in FIG. 1 during wrapping of the carpet roll, and a second or raised position (indicated in broken lines 44') in which the support structure 18 may be easily returned leftwardly along the beam to start position, i.e. after completion of wrapping of the roll 11 and prior to wrapping of a next roll. As shown, an actuator 47 is provided adjacent upright 43, with its cylinder 47*a* attached at 48 to that upright. The actuator rod 47*b* supports the beam 44 at its right end 44*a*, and operation of the actuator raises or lowers that beam.

Figure 4:
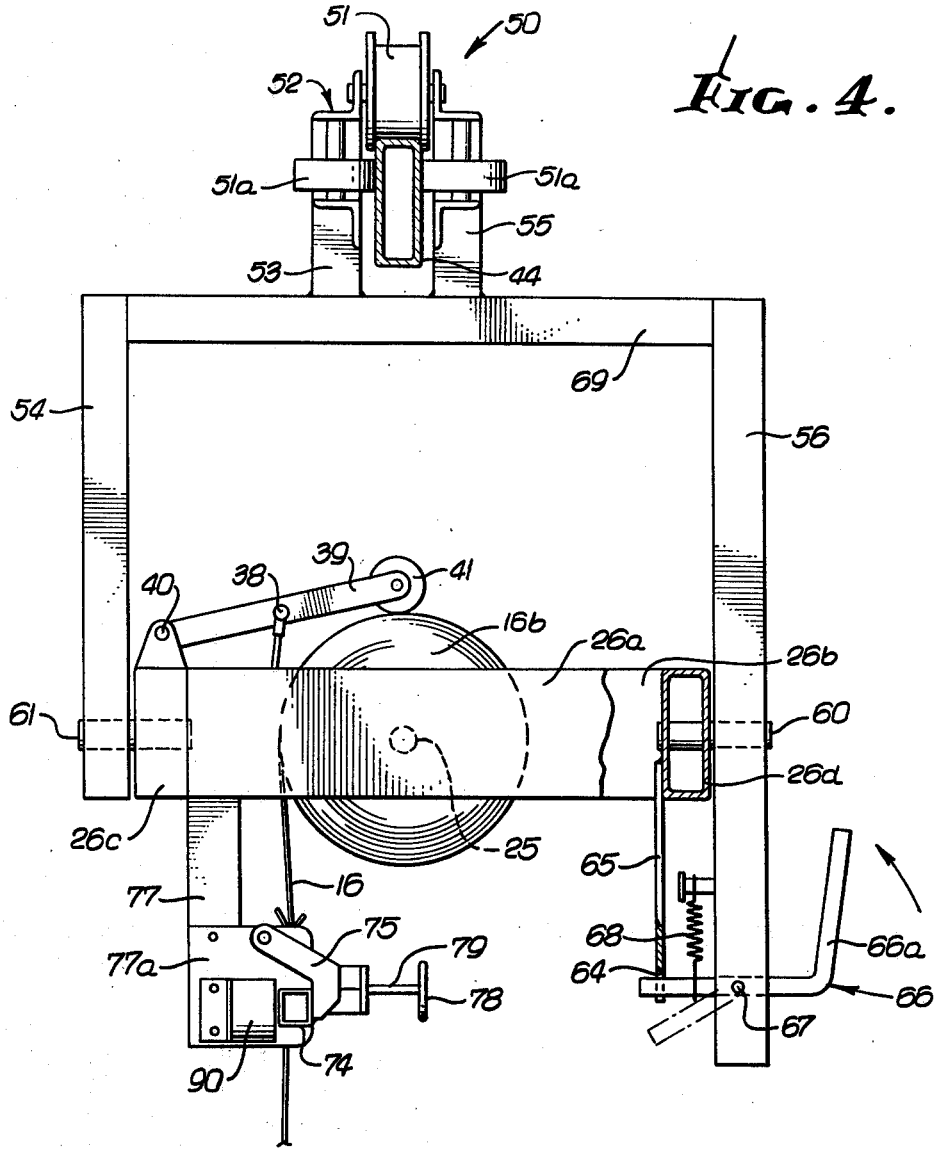
FIG. 4 is a fragmentary elevation taken on lines 4—4 of FIG. 3.

A truck is provided at 50 to have wheels 51 riding on the beam. Depending from the truck frame 52 interconnecting the wheels are hangers 53–56 via which the head or support structure 18 is suspended. Side wheels 51*a* on the truck engage the sides of the beam as seen in FIG. 4.

Figure 5:
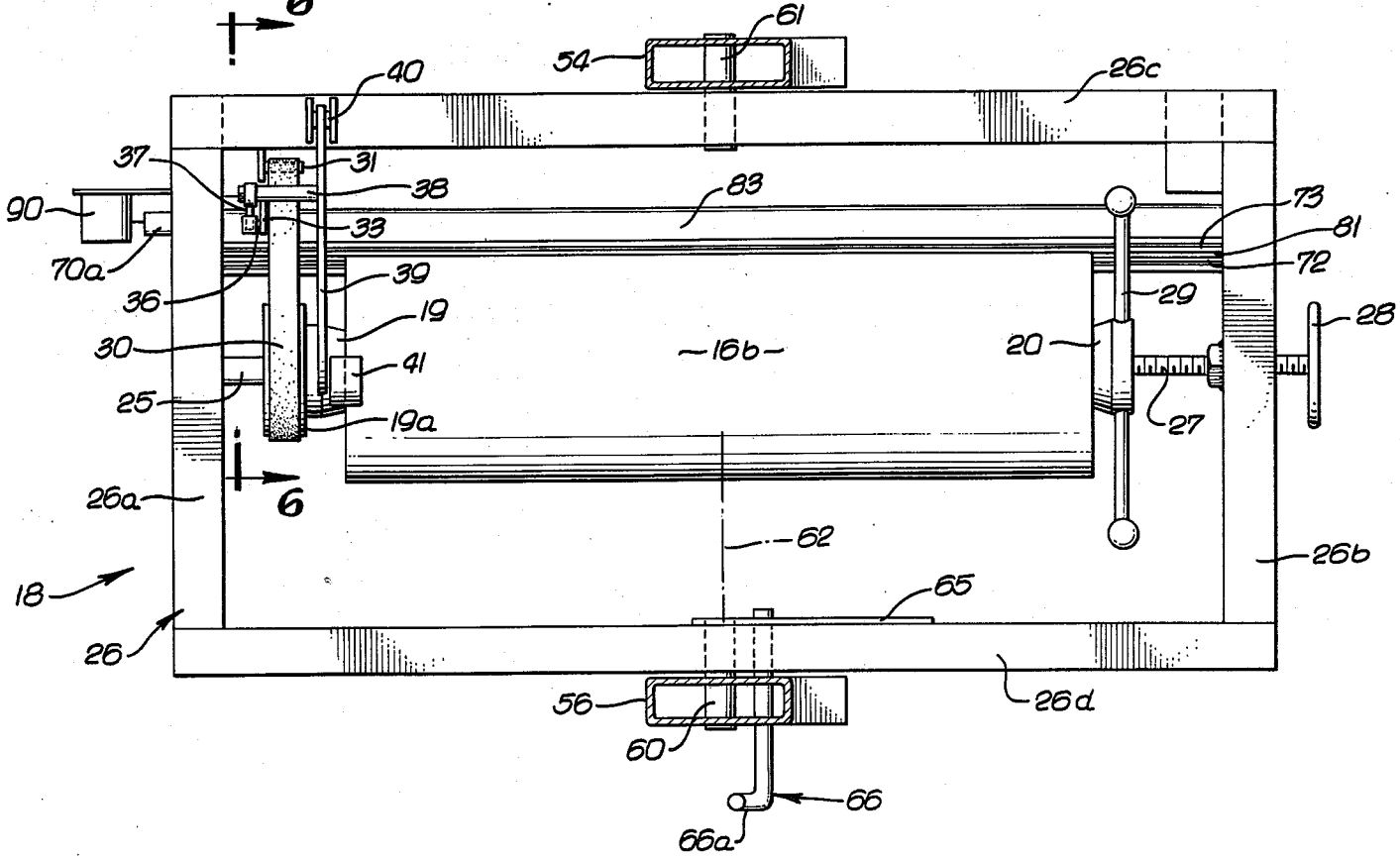
FIG. 5 is a plan view taken on lines 5—5 of FIG. 3.
Figure 6:
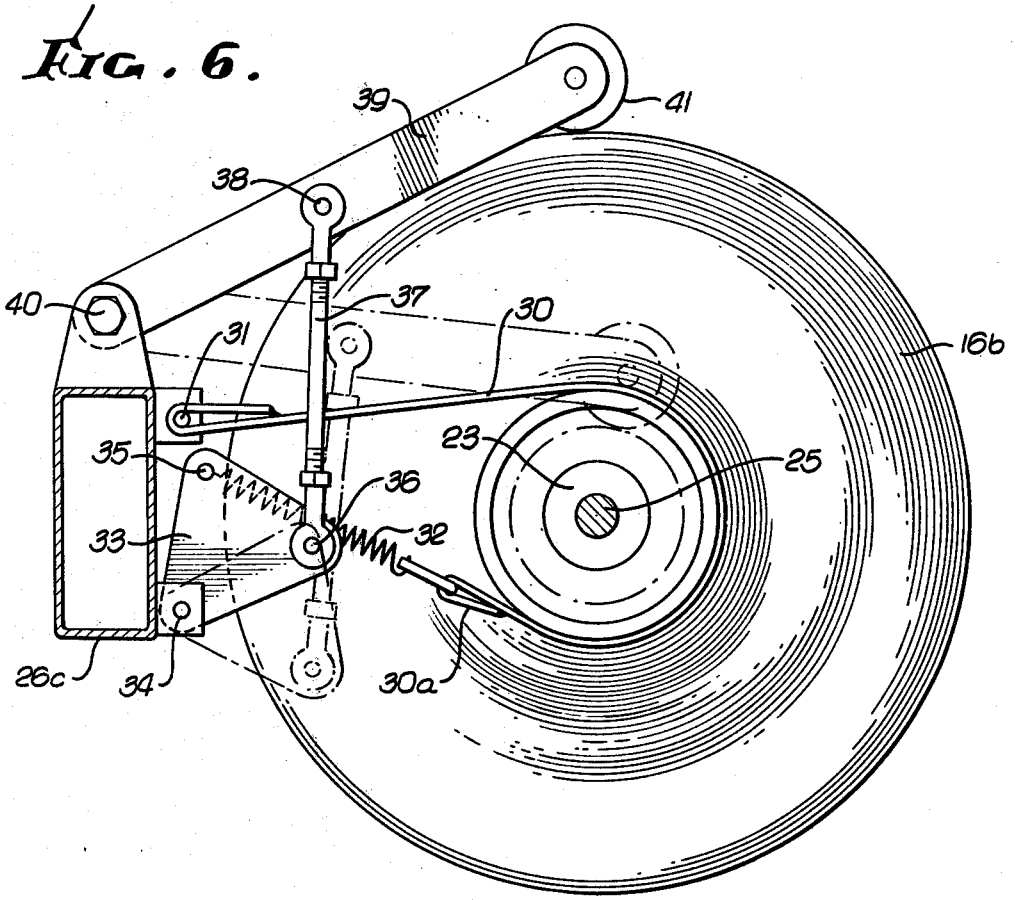
FIG. 6 is an enlarged end elevation on lines 6—6 of FIG. 5.

The support structure 18 has multiple feed positions into which it may be selectively shifted, thereby to vary the angularity of the skew feed direction 17 relative to carpet roll axis 12, to vary the spiral wrap angularity. Thus, for example, the head frame members 26*c* and 26*d* may be pivotally suspended at 60 and 61 from hangers 56 and 54, as best seen in FIGS. 3 and 5, the axis 62 of such pivots extending normal to an upright plane through carpet roll axis 12. The multiple feed positions of the head correspond to different positions of angularity of the head about axis 62, as is clear from FIGS. 1 and 3. In the latter, tongue and groove elements are shown, and which are relatively shiftable to hold the head 18 in a selected angular feed position. For example, grooves or slots 64 may be provided in a sector plate 65 attached to frame member 26*d*, as also seen in FIG. 4; and, a tongue in the form of a stop bar 66 is pivotally carried at 67 by hanger 56 to pivot upwardly into a slot 64 selected by adjustment rotation of the head 18 about axis 62. Tension spring 68 holds bar 66 upwardly into a selected slot, and a bar handle 66*a* is provided to enable ease of bar pivoting. FIG. 4 also shows a yoke member 69 interconnecting hangers 54 and 56, and hangers 53 and 55.

Figure 7:
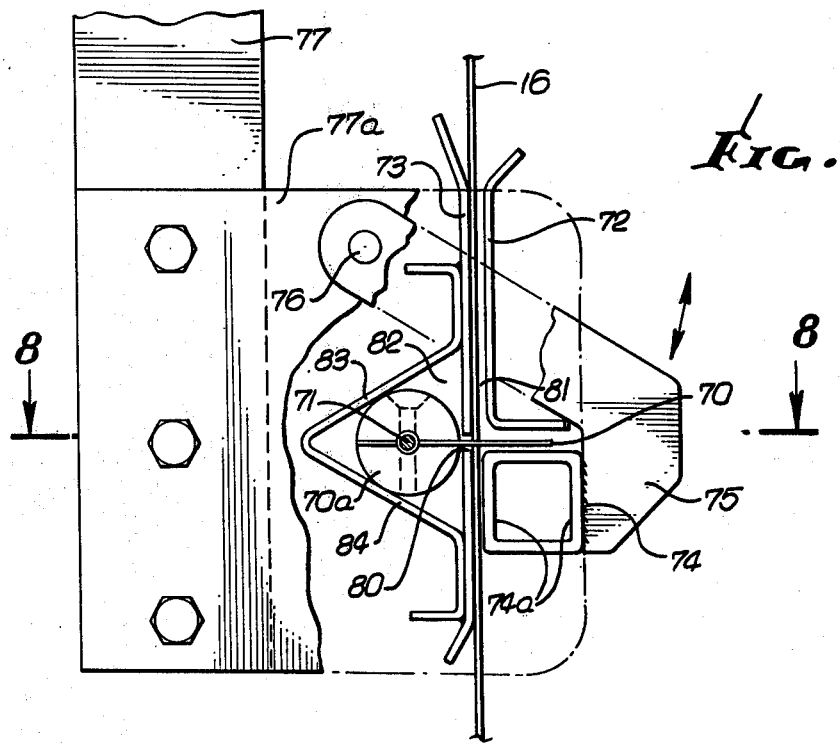
FIG. 7 is an enlarged end elevation on lines 7—7 of FIG. 3.

In accordance with a further feature of the invention, other means is provided in association with the support structure 18 for cutting a section of the sheet 16 crosswise or widthwise, to free it from the sheet roll 16*b*, as for example after completion of wrapping of the carpet roll. Referring to FIGS. 3, 4, 7 and 8, such other means may typically and advantageously comprise a cutter or blade 70, a line or cord 71 attached to the cutter and adapted to be displaced, as for example manually, and guide structure restraining the line to guide it for endwise movement crosswise of the sheet, and also restraining the sheet. Insofar as restraint of the sheet is concerned, the guide structure may include a chute for the sheet 16, as for example is shown in FIG. 7 by chute walls 72 and 73 which extend generally vertically at opposite sides of the sheet 16, and closely adjacent to same. The walls are carried by a square tubular frame part 74 suspended by an arm 75, pivotally connected at 76 to an auxiliary hanger 77 via plate 77*a*. The hanger 77 is connected to frame member 26*c*. As shown in FIG. 4, a hand wheel 78 rotates a shaft 79 having threaded connection to the arm 75. The end of the shaft abuts plate 77*a*, to adjust the angularity of the arm 75, and hence the chute walls 72 and 73. Accordingly, the paper is adjustably directed toward the roll 11, by the chute.

Figure 8:
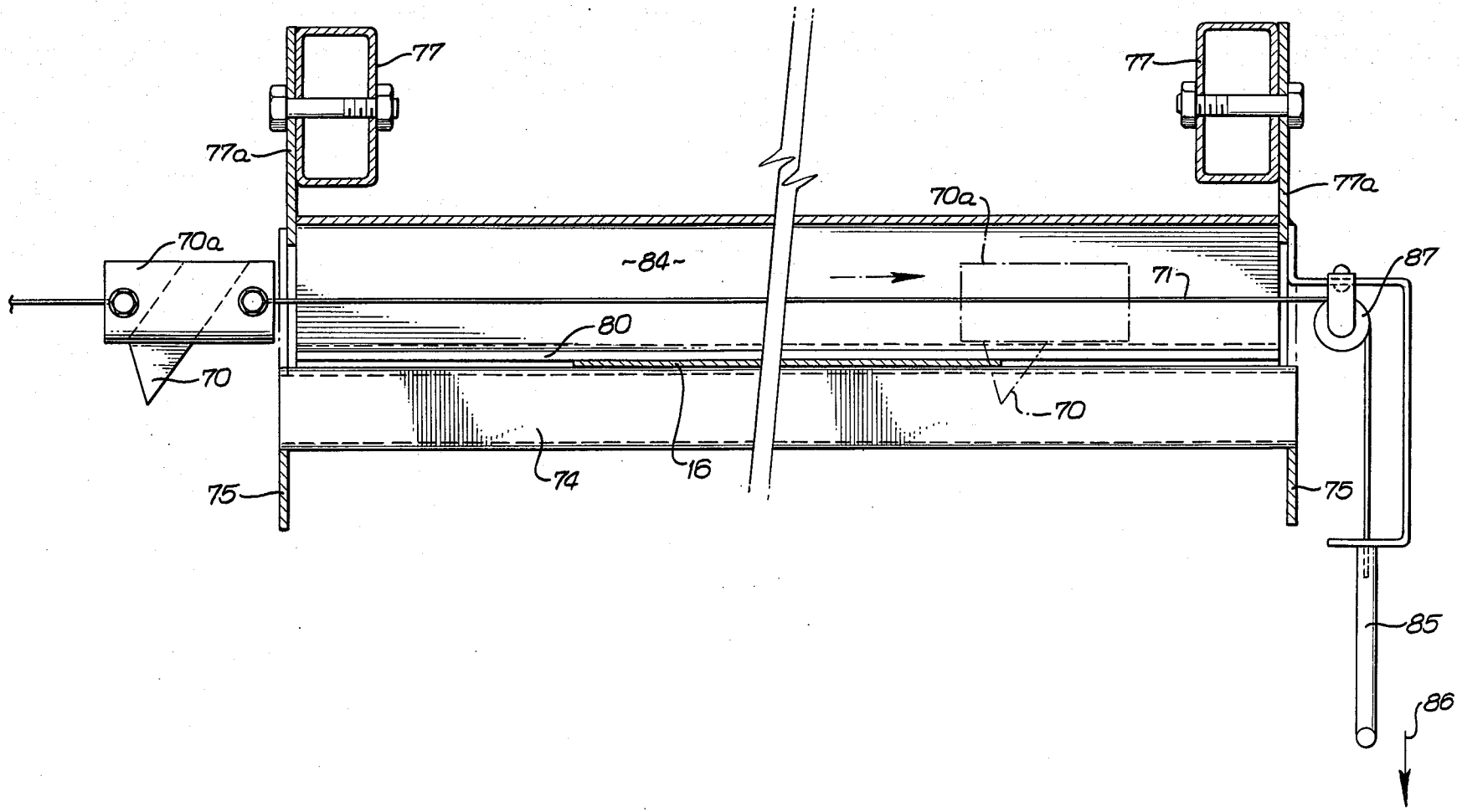
FIG. 8 is an enlarged downward looking section on lines 8—8 of FIG. 7.

Square tube part wall 74*a* tends to hold or position the paper or sheet 16 while it is severed by blade 70. The blade projects laterally in FIG. 7 through a guide slot 80 in chute wall 73 and crosswise of the chute 81, to sever the paper as the cord and blade are advanced lengthwise of the cord. A blade holder 70*a* has circular cross section, to be loosely guided within delta shaped guideway 82 defined by wall 73 and tapered panels 83 and 84. FIG. 8 shows a handle 85 attached to cord 71, and adapted to be pulled in the direction of arrow 86. The cord is directed about pulley 87, toward the handle. The main extent of the cord runs lengthwise of the head, and extends from a return spring urged cord reel 90 shown in FIG. 3.

In operation, the carpet or object roll is simply placed on support rollers 13 and rotated, the wrapper sheet 16 is extended, as by handle 29, and trained about the roll 11, with possible attachment to the roll surface as by taping, or insertion into the flap; and the turning of roll 11 serves to effect the spiral wrap, the head 18 traveling lengthwise of and along and above the carpet to dispense the sheet 16 at the correct rate and at the selected angle of wrap. Upon completion, the sheet is severed and beam 44 elevated, and the head 18 returned to start position. The end of the carpet may be covered by the remaining sheet length just below the severed terminal.

Two limit switches 110 and 111 are electrically connected to roll up drive means 14. Switch 110 responds to lowering of beam 44 to initiate the rolling action. Switch 111 responds to the arrival of carriage 55 and stops the roll up action when spiral wrapping is completed.

We claim:

1. For use in spiral wrapping a sheet about a longitudinally and horizontally axially elongated generally cylindrical object, the combination comprising (a) a frame including a beam member extending in the general direction of said object axis, and at a higher elevation than said axis, (b) means to rotate said object, (c) support structure carried by the beam to support a sheet roll to rotate about another axis angled from horizontal and to directionally feed the sheet toward and into parallel and close tangency to the object, in a skew feed direction relative to the other axis, in response to rotation of the object, (d) the beam member tilted at a downhill angle such that tension developed in the sheet during said feed thereof produces a force sufficient in itself to displace the support structure lengthwise along the beam member whereby as the object is rotated about its axis said sheet is fed from said roll and becomes progressively spirally wrapped about the object, and said displacement being at a speed corresponding to the axial rate of spiral wrap advancement along the object, (e) the support structure supported to pivot in the same angular tilt direction as said beam, and independently of beam tilt.

2. The combination of claim 1 wherein said support structure has multiple feed positions into which it may be selectively shifted, thereby to vary the angularity of said skew feed direction relative to the object axis, to vary the spiral wrap angularity.

3. The combination of claim 2 wherein said support structure includes tongue and groove elements which are relatively shiftable to hold the support structure in a selected feed position.

4. The combination of claim 1 including auxiliary means to manually rotate said support structure, and a brake mechanism operatively connected with the support structure and sensing the diameter of the sheet roll to decreasingly resist unwinding rotation of the sheet roll as the sheet roll reduces in outer diameter.

5. The combination of claim 1 including an actuator supporting said beam member to be tilted upwardly to aid return displacement of the support means along the frame member after completion of said wrapping of the object.

6. The combination of claim 1 including other means associated with said support structure for cutting a section of the sheet crosswise thereof to free it from the sheet roll.

7. The combination of claim 6 wherein said other means includes a cutter, a line attached to the cutter and adapted to be manually displaced, and guide structure restraining the line to guide it for endwise displacement crosswise of the sheet, and also restraining the sheet.

8. The combination of claim 1 including said object.

9. The combination of claim 8 wherein said object comprises a carpet roll.

10. The combination of claim 1 including a chute carried by the support structure to receive and direct the sheet unwound from the sheet roll toward the object.

* * * * *